US006220390B1

(12) United States Patent
Pike

(10) Patent No.: US 6,220,390 B1
(45) Date of Patent: Apr. 24, 2001

(54) ROOFTOP SCAFFOLDING

(76) Inventor: Charles E Pike, 50 Costello Rd., Brooklyn, CT (US) 06234

( * ) Notice: Subject to any disclaimer, the term of this patent is extended or adjusted under 35 U.S.C. 154(b) by 0 days.

(21) Appl. No.: 09/566,862

(22) Filed: May 8, 2000

(51) Int. Cl.[7] ..... E04G 1/36
(52) U.S. Cl. ..... 182/45; 248/237
(58) Field of Search ..... 182/45, 206; 248/237

(56) References Cited

U.S. PATENT DOCUMENTS 4,972,922 * 11/1990 Levine ..... 182/45
5,601,154 * 2/1997 Eisenmenger ..... 182/45

FOREIGN PATENT DOCUMENTS

540763 * 5/1957 (CA) ..... 182/45
11510 * 9/1893 (GB) ..... 182/45
2279688 * 1/1995 (GB) ..... 182/45

* cited by examiner

*Primary Examiner*—Alvin Chin-Shue
(74) *Attorney, Agent, or Firm*—Patrick J. Walsh

(57) ABSTRACT

Scaffolding for supporting one or more rooftop workers engaged in installing roofing materials such as roof shingles on an inclined roof.

2 Claims, 2 Drawing Sheets

ROOFTOP SCAFFOLDING

BACKGROUND OF THE INVENTION

The present invention relates to supports and particularly to scaffolding for supporting one or more rooftop workers engaged in installing roofing materials such as roof shingles.

Slanted roofs are commonly used in construction of residential and in some commercial buildings with the roofs covered by shingling of one kind or another. During the course of installing or repairing shingles on such slanted roofs, workmen require supporting scaffolding that can be positioned and repositioned as work progresses.

The prior art reveals several patents disclosing roofworker support structures including U.S. Pat. No 5,908,083 which discloses a pair of peak adjustable elongate assemblies deployable independently in substantially parallel position. Each elongate assembly includes an overpeak member and an adjustment member for the overpeak member, as well as one or more crosspiece support members for supporting a crosspiece or plank. In this arrangement, the crosspiece support members are in fixed locations on the elongate assembly so that the plank must be repositioned on another set of cross piece support members as work progress along the roof surface. In addition, support structures lie on the roof so as to require movement of the support structures laterally along the roof surface for installation of shingles in the space occupied by the support structures.

U.S. Pat. No 5,624,006 discloses a support apparatus for use on an inclined roof consisting of a ladder which hooks at one end to the roof ridge and a support frame secured to the ladder. The ladder lies directly on the roof surface, and the entire assembly must be positioned and repositioned along the length and breadth of the roof to complete a roofing job.

U.S. Pat. No 3,842,934 discloses an apparatus for laying roofing materials on a sloping roof comprising spaced load supporting members each having a load supporting carriage. The spaced carriages support the ends of a plank extending across the roof surface. The carriages advance up the load supporting members by means of a conventional ratchet jack mechanism. The load supporting members are spaced above the roof surface. The supporting members and carriages appear as a relatively heavy and rigid assembly so as to maintain spacing of the support members above the roof without deflecting onto the surface under a workman's weight thereby impeding the laying of materials. The assembly of supporting members and carriages constitutes a bulky and heavy arrangement that must be hand carried up a ladder and pushed up along a roof incline into working position with one end over a ridge peak. In addition, the design is also limited by a relatively slow dual jacking action to advance a supporting plank up a roof incline.

There is need for a lightweight, easy to place roof supporting structure spaced from the roof surface to allow for laying of material under the support, with means for mounting a workman's plank that can quickly move upward along the roof surface, and with a safety block plate for securing the workman's plank in any desired position on the roof incline. There is need to provide spacers beneath the support structure so that light weight support components can be used without deflection under a workman.

SUMMARY OF THE INVENTION

The present invention provides roof scaffolding comprising two or more elongate support members or tracks spaced above an inclined roof surface with the support members being in the form of upwardly open channels positioned in spaced, generally parallel relation of a roof surface. A hook at the upper end of each channel engages a roof ridge or ridge vent for holding each channel in place. Each channel receives a sliding brace held in selected position along the channel by a block plate. A roofer's plank spans the roof between sliding braces supporting a roofer in the task of laying roof materials. An aspect of the invention is to provide movable spacers to resist deflection of the support members intermediate their ends and in particular to resist deflection under a workman's weight on the scaffolding.

The support members are lightweight and are easily placed in position by hooking one end over the roof ridge or into a ridge vent. The support members include fixed end spacers for spacing the supports from the roof surface. Each sliding brace is moved into position on a support member and held by a block plate. Then a platform or plank spans the brace members providing a foothold for the roofer. The sliding braces can be selectively positioned in their channels along the support members as the roof installation proceeds along the roof surface. Moveable spacers are positioned under the support members in the vicinity of the workman to maintain roof spacing so as to permit laying of materials under the supports at all positions of the scaffolding on the inclined roof.

The invention provides roof scaffolding of lightweight components of robust construction which are easily placed in position and assembled, and which are readily adjusted in the course of applying roofing materials.

A specific example is included in the following description for purposes of clarity, but various details can be changed within the scope of the present invention.

OBJECTS OF THE INVENTION

An object of the invention is to provide roof scaffolding of robust, lightweight construction for ease of set-up and use on an inclined roof.

Another object of the invention is to provide roof scaffolding comprising separable components which are easy to install and adjust in the course of a roofing installation.

Another object of the invention is to provide roof scaffolding positioned above a roof surface with movable spacers particularly to hold the scaffolding against deflection under the weight of a workman.

Other and further objects of the invention will become apparent with an understanding of the following detailed description of the invention or upon employment of the invention in practice.

BRIEF DESCRIPTION OF THE DRAWING

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE PREFERRED EMBODIMENT

Figures 1, 2, 3:
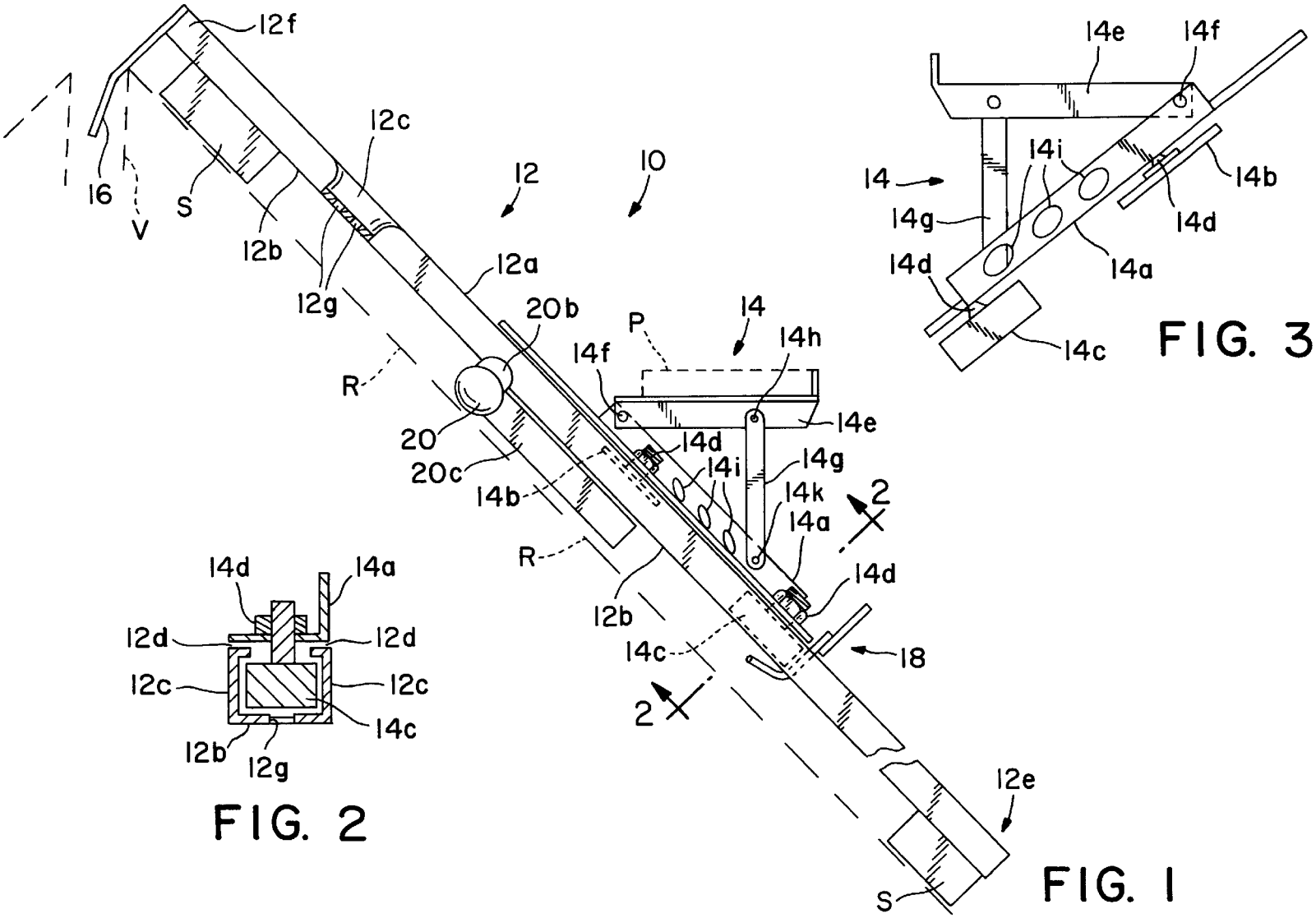
FIG. 1 is side elevational view of roof scaffolding according to the invention in position on an inclined roof, with the support member shown partly in section.
FIG. 2 is an enlarged section view taken along line 2—2 of FIG. 1.
FIG. 3 is a side elevational of a sliding brace component of roof scaffolding showing the rear side of the same brace shown in assembly in FIG. 1.

Referring to the drawing, roof scaffolding 10 according to the present invention comprises a plurality, preferably a pair, of support members or tracks 12 positioned on a inclined roof R. Each support member comprises an elongate support in the form of an upwardly open channel 12*a* defined by bottom 12*b* and side walls 12*c* and inturned upper side wall flanges 12*d*. The channel is open at its lower end 12*e* for sliding entry of sliding plank braces 14, and closed at its upper end by a downwardly depending hook 16 welded over the top end 12*f*.

Figure 6:
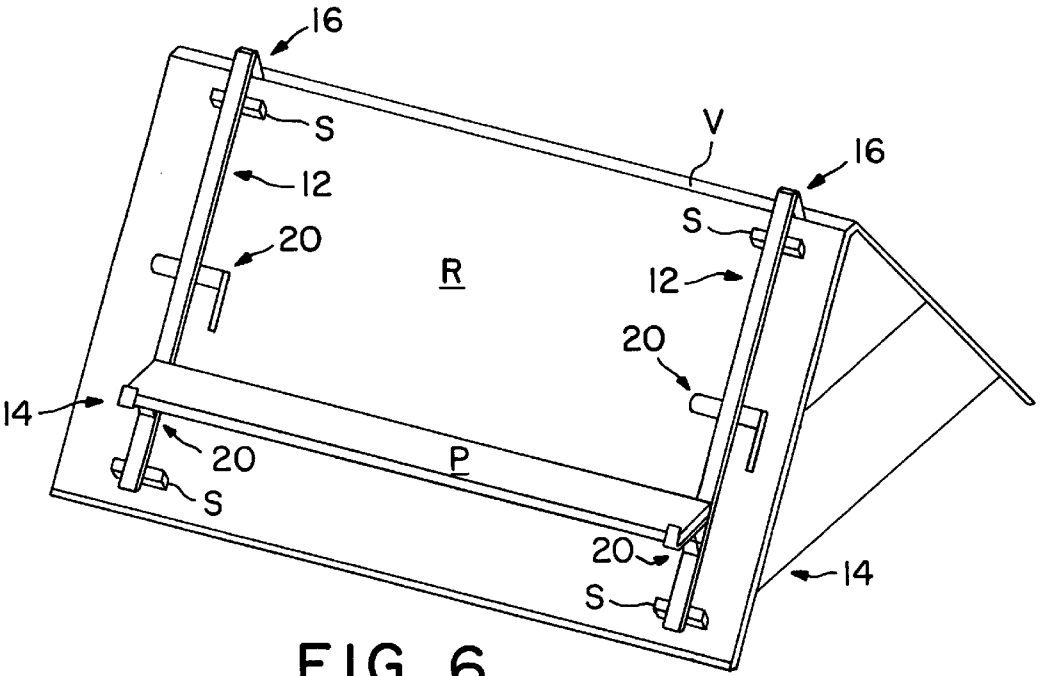
FIG. 6 is a schematic perspective view illustrating the position of roof scaffolding on an inclined roof for installing roofing materials.

The full length of bottom wall of the channel contains spaced apertures 12*g* for mounting a block plate 18 in supporting position behind each assembled plank support brace 14 as shown in FIG. 1. As shown in FIGS. 1 and 6, a plank P extends across the roof between plank support braces 14.

A movable support 20 may be positioned between the channel bottom wall 12*b* and roof surface R enabling the support tracks 12 to resist deflection toward the roof surface particularly under the weight of a roofer occupying the scaffolding in the course of installing roof materials.

Opposite sides of the sliding plank support brace 14 are shown in FIGS. 1 and 3 in which the brace comprises a base 14*a* preferably formed of angle iron with forward 14*b* and aft 14*c* sliding shoes which position and retain the brace for sliding movement along the entire length of the channel. The shoes are secured to the brace by suitable fasteners 14*d*. The forward shoe 14*b* is in the form of a flat plate of width selected for ease of entry into the channel and for engagement with the under surface of channel flanges 12*d*. The aft shoe is in block form of dimensions to fit and slide freely in the channel and to engage the under surface of the channel flange as shown in FIG. 2.

The base 14*a* pivotally receives a plank support member 14*e* (preferably an angle iron) held by rivet 14*f*. The plank support member in turn receives adjustable supporting strut 14*g* pivotally mounted by a bolt or rivet 14*h*. The lower end of the strut is selectively positioned in one of several ovate eyelets 14*i* in base member by means of a rivet head 14*k*. The adjustable strut allows for positioning the plank support member 14*e* in a more or less horizontal position in relation to different roof inclinations.

Each sliding plank brace is entirely slidable in its channel from the lower to upper ends of the channel and is disassembled by sliding out of the lower end of the channel.

Figure 4:
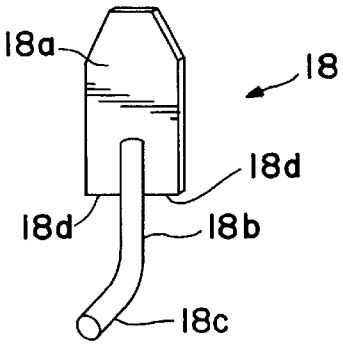
FIG. 4 is a perspective view of a block plate forming part of the scaffolding of FIG. 1.

A block plate 18 shown in FIGS. 1 and 4 is placed in position in the channel 12*a* behind the plank brace 14 to hold the brace stationary against the full weight of plank P, roofer and any roofing materials or tools situated on the plank. The block plate comprises a plate portion 18*a* with depending leg 18*b* secured thereto. The lower end 18*c* of the stop leg is bent forward so that when installed the lower end lies under the channel. The block plate cannot be removed while the plank brace and the block plate are as shown in FIG. 1. For installing and removing the block plate in selected operative position, the plank brace must slide forward in the channel to allow manipulation of leg into and out of a channel aperture 12*g*.

In use, the block plate leg slips through an aperture in the channel with the plate 18*a* behind the plank brace, and with block plate shoulders 18*d* engaging the top of in-turned channel flanges 12*d*. It is to be understood that the plank brace may be slid further up the channel to another position without first removing the block plate. After the plank brace is moved along the channel to another position, the block plate itself is moved into position behind the brace holding it in its new position.

Each of the channel members is supported above a roof surface by spacers S at the upper and lower ends of the channel. The entire span of the channels along the roof incline is so spaced to facilitate installation of roofing materials under the channels.

Figure 5:
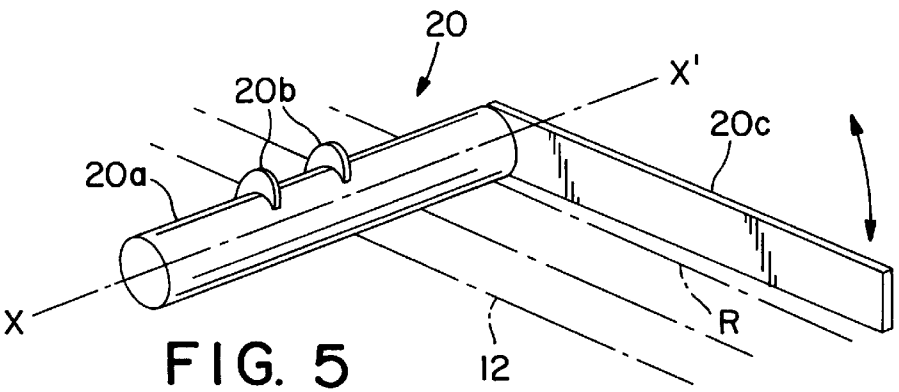
FIG. 5 is a perspective view of a movable support for roof scaffolding.

In order to compensate for deflection of the channel members under full operational weight, a movable support 20 shown in FIGS. 1, 5 and 6 may be positioned under each channel 12. The movable support comprises a support cylinder 20*a* with spaced shoulders 20*b* for placement under the channel 12 with the channel spaced between the shoulders. The shoulders disengage the channel when the support cylinder is rotated up to 90° about the cylinder axis x–x' so that the support cylinder can be moved laterally from under the channel.

The movable support includes a lever arm 20*c* for rotating the cylinder and shoulders such that the support can be slipped under the channel without interference between channel and shoulders. When the support is in place (FIGS. 1 and 5), the lever arm lies along the roof R adjacent the channel in an out of the way position. The shoulders 20*b* maintain the support cylinder at a right angle to the channel. For removal, lever arm 20*c* and shoulders 20*b* are rotated to the dash line position of FIG. 1 and the support is moved laterally from under the channel. If desired, the support can be repositioned simply by movement along the roof under the channel to another location supporting the channel. An aspect of the invention is that the movable support can be positioned at any point under the channel and is particularly suitable for placement under the channel in the vicinity of the roofer to resist channel deflection toward the roof.

The roof scaffolding is shown in schematic form in FIG. 6, in which spaced parallel supporting channels 12 have hooks 16 retained in ridge vent V, channels spaced from roof surface by end spacers S and movable spacers 20, plank support braces 14 in position with plank more or less horizontal for roofer comfort, and with block plates 18 in retaining position behind the braces.

Various changes may be made to the structure embodying the principles of the invention. The foregoing embodiments are set forth in an illustrative and not in a limiting sense. The scope of the invention is defined by the claims appended hereto.

I claim:

1. A roof scaffolding assembly for the surface of an inclined roof comprising an elongate channel member defined by a bottom wall and spaced upstanding side walls each terminating in an inturned upper side wall flange, the bottom wall having apertures therein, the channel member having upper and lower ends, the channel member being supportable above the roof by spacers at the upper and lower ends of the channel whereby the entire span of the channel may be spaced from the roof surface to facilitate installation of roofing material beneath the channel, a plank brace member having a base and a plank supporting member, the brace member base having one side fitting laterally over the inturned upper side wall flanges and with another side of the base being pierced by a plurality of adjustment apertures, the base having a forward shoe for ease of entry of the brace member into the channel beneath the inturned flanges, and an aft shoe fitted into the channel to accommodate sliding movement in the channel, the plank supporting member pivotally connected to the base adjacent the forward shoe, a support and adjustment strut at one end pivotally connected to the plank supporting member and at its other end being in registry with an adjustment aperture of the base so as to position the plank supporting member in a more or less horizontal position, a hook affixed to the upper end of the channel for removably attaching the channel member to a roof ridge, a block plate having a plate portion and a depending leg secured thereto, the depending leg being inserted into a channel aperture behind the plank brace member for blocking downward movement of the plank brace member in the channel, and a movable support member for selective placement under the channel to resist deflection of the channel toward the roof under the weight of a workman, the movable support member having a cylindrical body for placement under the channel member to resist deflection of the channel under the weight of a workman, a pair of spaced shoulders on the cylindrical body for engaging the outer side of the side walls of the channel to maintain the cylindrical body in position under the channel, a lever arm affixed to an end of the cylindrical body whereby the cylinder may be rotated about its axis to disengage the shoulders from the channel for lateral movement of the movable support member from under the channel.

2. A roof scaffolding assembly for the surface of an inclined roof comprising an elongate channel member defined by a bottom wall and spaced upstanding side walls each terminating in an inturned upper side wall flange, the bottom wall having apertures therein, the channel member having open upper and open lower ends, the channel member being supportable above the roof by spacers at the upper and lower ends of the channel whereby the entire span of the channel may be spaced from the roof surface to facilitate installation of roofing material beneath the channel, a plank brace member having a base and a plank supporting member, the brace member base being an elongate angle iron with one side fitting laterally over the inturned upper side wall flanges and with the other side of the angle iron extending normal to its one side and being pierced by a plurality of adjustment apertures, the base having a forward shoe in the form of a flat plate for ease of entry of the brace member into the channel beneath the inturned flanges, and an aft shoe in the form of a block to accommodate sliding movement in the channel while retaining the brace in the channel, the plank supporting member pivotally connected to the base adjacent the forward shoe, a support and adjustment strut at one end pivotally connected to the plank supporting member and at the other end being in registry with one of the adjustment apertures of the base so as to position the plank supporting member in a more or less horizontal position, a hook affixed to the upper end of the channel for removably attaching the channel member to a roof ridge, a block plate having a plate portion and a depending leg secured thereto, the depending leg being bent forward, the depending leg being inserted into a channel aperture behind the plank brace member for blocking downward movement of t e plank brace member in the channel, and a movable support member for selective placement under the channel to resist deflection of the channel toward the roof under the weight of a workman, the movable support member having a cylindrical body for placement under the channel member to resist deflection of the channel under the weight of a workman, a pair of spaced shoulders on the cylindrical body for engaging the outer side walls of the channel to maintain the cylindrical body normal to the channel, a lever arm affixed to an end of the cylindrical body whereby the cylindrical body may be rotated about its axis to disengage the shoulders from the channel for lateral movement of the movable support member from under the channel.

* * * * *